US007352886B1

(12) United States Patent
Kennedy et al.

(10) Patent No.: US 7,352,886 B1
(45) Date of Patent: Apr. 1, 2008

(54) ERROR HANDLING IN A HIGH THROUGHPUT COMPUTER-AIDED DETECTION ENVIRONMENT

(75) Inventors: Craig Kennedy, Dayton, OH (US); Thomas Fister, Lebanon, OH (US); Michael Bettencourt, Bellbrook, OH (US); Jason Sattler, Beavercreek, OH (US)

(73) Assignee: iCad, Inc., Nashua, NH (US)

( * ) Notice: Subject to any disclaimer, the term of this patent is extended or adjusted under 35 U.S.C. 154(b) by 622 days.

(21) Appl. No.: 10/298,345

(22) Filed: Nov. 18, 2002

Related U.S. Application Data

(60) Provisional application No. 60/333,807, filed on Nov. 20, 2001.

(51) Int. Cl.
*G06K 9/00* (2006.01)
*B65H 1/00* (2006.01)

(52) U.S. Cl. ..... 382/132; 271/8.1; 358/498

(58) Field of Classification Search ..... None
See application file for complete search history.

(56) References Cited

U.S. PATENT DOCUMENTS 4,753,430 A * 6/1988 Rowe et al. ..... 270/58.03
4,757,984 A * 7/1988 Rowe et al. ..... 270/58.03
4,760,574 A * 7/1988 Budworth et al. ..... 714/706
4,936,562 A * 6/1990 Rowe ..... 270/56
5,226,640 A * 7/1993 Puzey ..... 271/107
5,917,929 A * 6/1999 Marshall et al. ..... 382/128
6,040,923 A * 3/2000 Takashimizu et al. ..... 358/498
6,115,488 A 9/2000 Rogers et al.
6,633,782 B1 * 10/2003 Schleiss et al. ..... 700/26
6,970,587 B1 * 11/2005 Rogers ..... 382/132
7,146,031 B1 * 12/2006 Hartman et al. ..... 382/132
7,158,244 B2 * 1/2007 Sommer et al. ..... 358/1.13
2003/0040820 A1 * 2/2003 Staver et al. ..... 700/86
2005/0149360 A1 * 7/2005 Galperin ..... 705/2

FOREIGN PATENT DOCUMENTS

WO WO 02/45437 A2 6/2002

* cited by examiner

*Primary Examiner*—Bhavesh M Mehta
*Assistant Examiner*—Charles Kim
(74) *Attorney, Agent, or Firm*—Dinsmore & Shohl LLP

(57) ABSTRACT

A method and system for automated detection and handling of film feeding failures in a high-volume CAD environment. The method provides for batch processing a set of films including multiple film cases including the steps of providing a number count of the number of films corresponding to each film case and identifying a difference between the processed number and the number count as a process error for the film case. The method also provides for batch processing a set of films including multiple film cases including the steps of providing at least one error check on the status of processing the films in the set of films and completing processing of all film cases in the set of films after a process error is identified in one film case.

18 Claims, 3 Drawing Sheets

ERROR HANDLING IN A HIGH THROUGHPUT COMPUTER-AIDED DETECTION ENVIRONMENT

CROSS-REFERENCE TO RELATED APPLICATIONS

This application claims the benefit of U.S. Provisional application Ser. No. 60/333,807, filed Nov. 20, 2001, incorporated herein by reference.

BACKGROUND OF THE INVENTION

1. Field of the Invention

This invention relates to a method and system for assisting the high throughput use of computer-aided detection systems. One primary aspect of high throughput processing relates to automated detection and handling of errors in the film digitization process.

2. Discussion of Related Prior Art

In 2001 an estimated 239,300 women were diagnosed with breast cancer and 40,200 women died from it. Mammography, along with physical examination, is the current procedure of choice for breast cancer screening. Screening mammography has been responsible for an estimated 30 to 35 percent reduction in breast cancer mortality rates. Although mammography is the preferred means of breast cancer screening, it is not perfect. Ten to thirty percent of women diagnosed with breast cancer have their mammograms interpreted as negative. Furthermore, of the malignancies missed by radiologists, an estimated two-thirds are retrospectively evident in the screening mammograms. Missed detections may be attributed to several factors including: poor image quality, interpretation error, lesion obscuration, subtle nature of radiographic findings, eye fatigue, or oversight.

To increase sensitivity, a double reading has been suggested. However, the additional time and expense of a second radiologist makes this option unlikely. Alternatively, a computer-aided diagnosis system may act as a "second reader" to assist the radiologist in detecting and diagnosing lesions. Computer-aided second reading systems, such as the commercially available Second Look® CAD system, (CADx Systems, Beavercreek, Ohio) have been clinically proven to decrease the rate of missed cancers. Thus, the computer-aided second reading clearly benefits women and their families.

The promise of earlier detection has made many women choose centers providing CAD services. The U.S. government encourages the purchase and use of CAD systems by providing reimbursement to radiologists or hospitals using such systems. In the four and a half years of commercial availability, approximately 5 million women have had their mammograms processed by CAD systems. As the number of cases continues to increase, automated methods for efficient processing and billing for CAD services are essential.

An overview of the typical workflow a mammography center is now provided. A radiology technologist enters patient identification information into an electronic system. Then, the technologist positions the patient in the mammography x-ray device and exposes four films, collectively referred to as a case. The films include two views of each breast, the cranio-caudal and medial-lateral oblique. Before development, patient information may be "flashed" onto the films. They are then developed and inspected to ensure compliance with the Mammographic Quality Standards Act (MQSA). MQSA compliant cases are then loaded into the digitizer of the CAD system by the radiology technician. The technologist uses interface devices such as a keyboard, mouse, touch screen, or speech recognition application to control the CAD system operation and input patient identification information. The digitizer feeds the films one at a time, creating a set of four digital images from a typical case. These digital images are analyzed for signs of cancer by algorithms in the CAD system.

The CAD system produces a visual or textual indication of the location and type of cancer indicator suspected. The output is typically either a printed page or electronic file consisting of the digital mammogram images with suspicious regions highlighted by markers; different marker styles are used to denote different indicators of cancer. When the CAD output is a printed page, it may be stored with the films. When the CAD output is an electronic file, it is stored and recorded such that it may be recalled from patient identification information and printed or displayed on a monitor. The radiologist subsequently uses the CAD output during an interpretation phase. The procedure for incorporating CAD system outputs is given in U.S. Pat. No. 6,115,488, herein incorporated by reference.

To maximize technologist productivity and efficiency, it is desirable to accumulate a number of cases before processing. Typically, the number of accumulated cases requires an overnight's amount of time to process. The collection of films is loaded into the digitizer, patient information is entered, and commands issued to the CAD system to begin processing in the "batch" mode. The cases are processed overnight, producing a collection of CAD outputs. The next morning, the processing is complete. Currently, the average time required to process a standard four-film case is approximately 4-6 minutes. Assuming 14 hours available in an overnight interval, 210 to 140 cases may be processed in an otherwise unused time span. For systems creating paper output, the pages are associated with the proper films for subsequent use by a radiologist.

Batch operation has the disadvantage of being dependent on perfect feeding of films through the digitizer. A common feed error in digitizers is the "double feed" where two films are pulled through the system as one. Mechanisms for sticking include static electricity and film-to-film suction. In a system that relies only upon an input number of films in a case and a digitizer counting the number of digitizer feed commands, the double feed error can cause a misassociation of patient information with CAD system output. To prevent this misassociation, an operator may monitor the processing, stop the processing when a double feed is observed, reload the affected films, and re-start the processing. This is clearly an inefficient use operator time. Alternatively, the CAD system may detect the double feed error, and stop the batch processing. This has the undesirable effect of delaying the night's processing until the operator corrects the situation the following morning. Clearly it is desirable to provide a system and method for allowing automated handling of feed errors in a batch processing environment.

SUMMARY OF THE INVENTION

In the above high volume CAD environment, film-feeding errors can result in association errors between patient identification information and films. To combat this situation, work list information and case separators are used to provide robust error detection and handling methods. These methods will reduce the amount of re-work required by an operator and allow batch processing to continue even in instances of film-feed errors.

Accordingly, it is an object of this invention is to provide a method and system for automated detection and handling of film feeding failures in a high-volume CAD environment.

In one aspect of the invention a method is provided for batch processing a set of films including multiple film cases, the method including the steps of: providing a number count of the number of films corresponding to each film case; processing the set of films with a computer system; determining a processed number of films processed by the system for each film case; comparing the processed number to the number count for each film case; and identifying a difference between the processed number and the number count as a process error for the film case.

In another aspect of the invention a method is provided for batch processing a set of films including multiple film cases, the method including the steps of: providing at least one error check on the status of processing the films in the set of films; processing the film cases in the set of films with a computer system; identifying a process error during processing based on the at least one error check; and completing processing of all film cases in the set of films after a process error is identified in one film case.

Other objects will be readily perceived from the following description, claims, and drawings.

DETAILED DESCRIPTION OF THE PREFERRED EMBODIMENT

Overview

Figure 1:
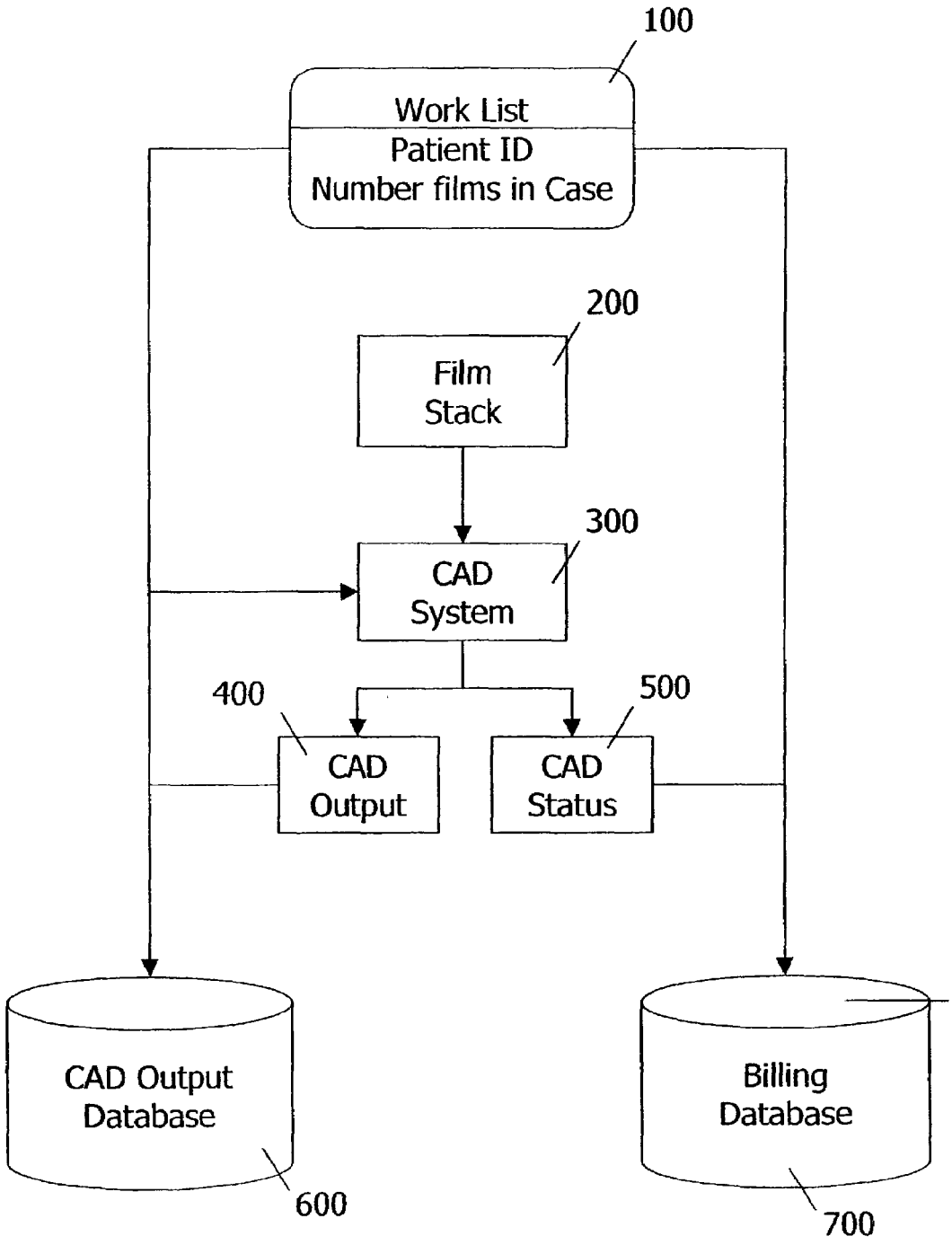
FIG. 1 is an overview of the system.

FIG. 1 shows an overview of the high throughput CAD system. Patient identification information and the number of films for that patient's case are entered in a work list, 100. The work list typically contains information regarding a plurality of patients. The films associated with the patients are combined to form an input film stack, 200. The film stack is input to a CAD system, 300, along with associated patient information from the work list. The patient information includes the number of mammographic images in that patient's case. The CAD system processes digital versions of the mammographic films and then produces a CAD output, 400. The system creates an electronic CAD output that may be displayed on a monitor, printed, or stored for subsequent use. The electronic CAD output is stored with patient ID information in a CAD output database, 600. The processing status of each case is determined in step 500 and stored with patient ID information in a billing database, 700. Although this embodiment shows the databases as separate entities, in an alternative embodiment, a single database may be used to store and access both the actual CAD output and the CAD status information.

Figure 2:
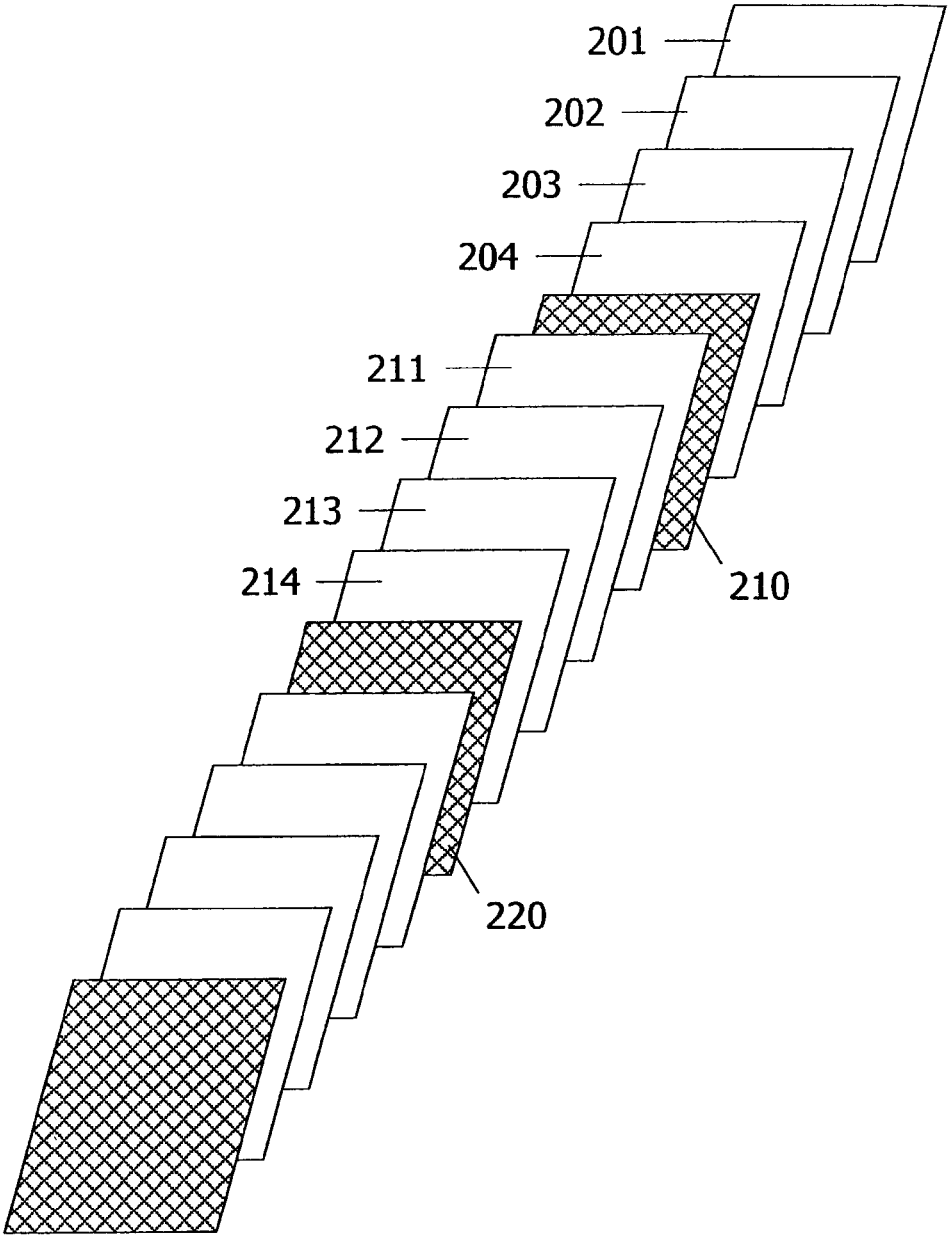
FIG. 2 is an example of a film stack.

An example of an input film stack is shown in FIG. 2. The input stack consists of the first patient's mammography images, 201, 202, 203, and 204; a case separator, 210; the second patient's mammography images, 211, 212, 213, and 214; a case separator, 220, and so on. A case separator is a film with unique markings allowing it to be rapidly and reliably distinguished from a mammographic image.

The key elements in the double feed detection method are the work list and the case separators. The fundamental operation of the double feed detection method is to read the expected number of films in a case from the work list, and then count the number of film feed operations issued until the next case separator is detected. In the error free situation, the number of film feed operations between case separators equals the number of films indicated in the work list. When this occurs, the final case status is reported as "complete". If a case separator is detected with fewer feed operations than the number of films in a case, a double feed error is assumed, and status for the current case is reported as "canceled" and a message indicating a "Film Sequencing Error" is associated with the CAD output. Another error mode is the situation of a CAD processing failure on an image. Since CAD systems typically rely on valid CAD output for all images in the case, the case status must be reported as "failed".

Work List

The work list contains patient identification information and the number of film images in the case. Additional information, such as medical history and demographics may also be included.

In one embodiment, an operator enters patient information prior to CAD processing. Alternatively, the CAD system decodes patient information directly from the films; the patient information may then be accumulated during CAD processing. Information associated with the images includes patient name, patient identification number, patient date of birth, initials of technologist, time the output image created, and size of films.

Preferably, the system stores the patient work list information in non-volatile memory such that if the system loses power, the work list information is available after power is restored. This allows for re-starting a batch job without re-entering patient identification information.

The work list may be edited whether or not CAD processing is currently running. That is, patients may be added to the work list while the system is currently running a batch job. The corresponding films are added, in order, to the end of the film stack.

Case Separator

The system distinguishes between the end of one case and the beginning of another via a case separator inserted in the appropriate position of the collection of films in the input batch. In the present invention, a case separator is typically a film exhibiting a unique pattern. The purpose of the pattern is to provide a cue recognizable by the CAD as a case separator and difficult to misrecognize as a medical image. Highly accurate detection of case separators may be obtained by correlating the pattern with the input image. The case separators are positioned between films of different cases. The user inputs the number of films in each patient's case in the work list. This allows the system to detect a digitizer feed error (double feed) or misrecognition of a case separator. Processing may be allowed to proceed after detection of the errors using the knowledge of the number of films in each case as entered by the operator or as determined from on film information.

Error Handling

Figure 3:
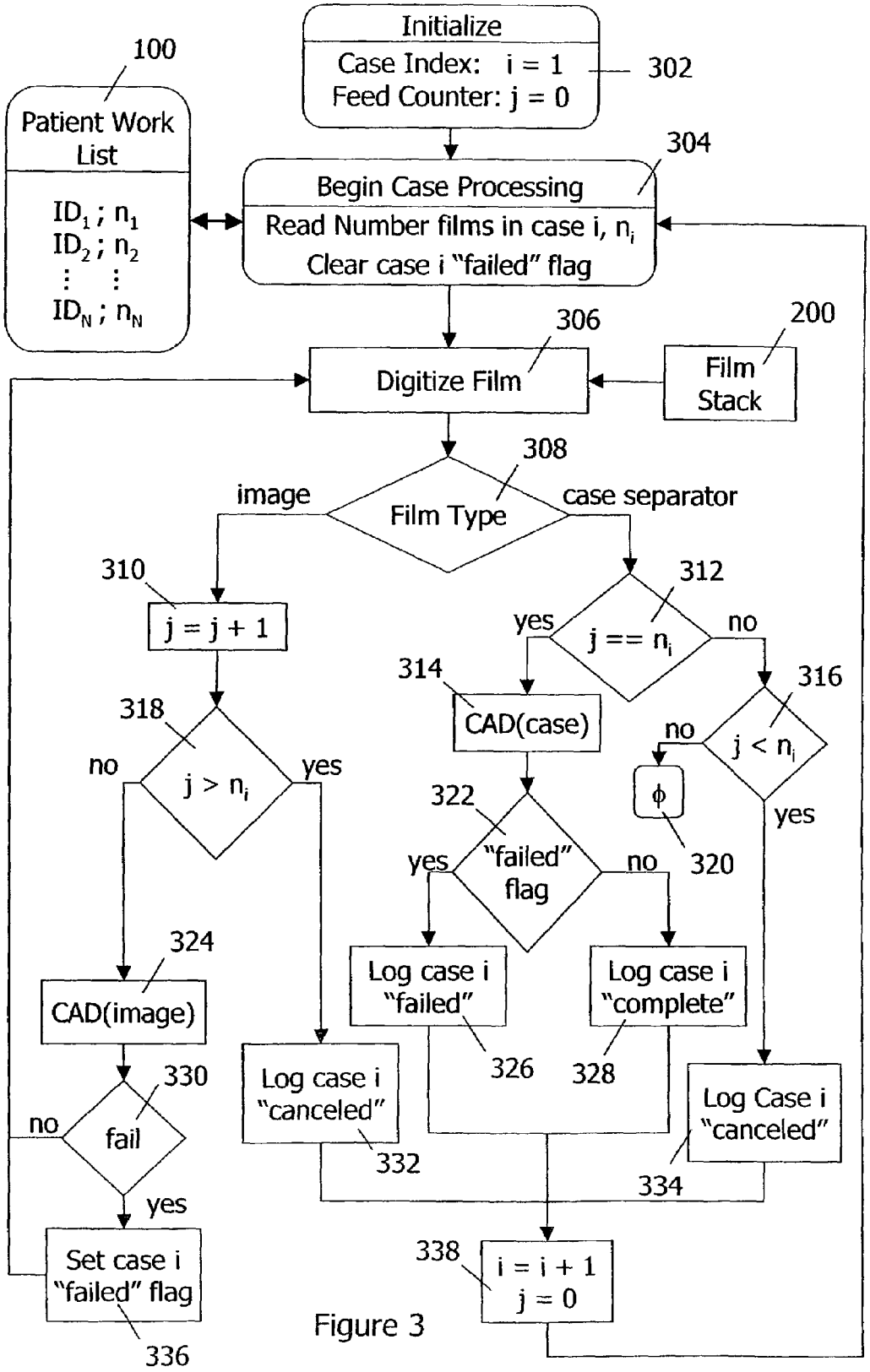
FIG. 3 shows details of double feed detection and error handling logic.

FIG. 3 shows a detailed block diagram of the error handling method of the invention. The lesion detection portion of the CAD is not shown in this figure for clarity. The patient work list, 100, provides patient identification information and the number of films in each patient's case. Upon initialization of batch processing, step 302, the case index is set to one and the feed counter set to zero. Case processing begins in step 304. Here the number of films in case i is read from the work list and stored as n, and the "failed" flag is cleared. The steps of the figure below step 304 contain decision paths to handle double feed errors and CAD processing failures. For completeness in describing FIG. 3, note step 320 is the null state. That is, given the construction of the algorithm, it is a step that cannot occur.

The following sections describe how different error conditions are handled by the system. The desirable result is that this method allows batch processing to continue when feed errors occur. Another desirable result is the creation of a log allowing convenient generation of billing reports.

Each case processed by the CAD system receives a CAD processing status label. In the present invention, the labels are "complete", "canceled", and "failed". Completed cases require no special attention from an operator. However, canceled and failed cases require operator intervention. Both types are typically re-processed by the CAD system. The status labels provide information for the operator to efficiently locate the necessary cases. Double feed errors resulting in canceled cases are unlikely to recur upon re-processing. Cases with a film or films resulting in recurring CAD processing errors may be of interest to CAD system designers.

Error Free Operation

The operation of the error handling method is first described for the error free situation. The next available film from the film stack, 200, is digitized in step 306. The type of film is determined in step 308. The films in the stack must be either a mammographic image or a case separator. Considering the first film to be a mammographic image, the left branch is taken from step 308. The film feed counter is incremented by one in step 310. In step 318, the film feed counter, j, is compared to the number of films in the case, $n_i$, as specified in the work list. If j is less than $n_i$, the digital image is submitted to the CAD system for image based processing, step 324. The image based CAD is assumed to successfully complete, therefore the "failed" flag remains cleared. Step 330 checks the state of the "failed" flag. Since no failure is indicated, the next film in the case is feed through the digitizer in step 306. This sequence of events repeats three more times.

After four feed operations, the feed counter j equals four. The next film digitized will be determined to be a case separator in step 308. In this situation, the right branch is followed from step 308. The feed counter is compared to the number of films in the case in step 312. For this error free example, the feed counter equals the number of films in the case and the left branch taken from step 312. The next step, 314, applies case based CAD processing to the prior $n_i$ films. Next, in step 322, the "failed" flag is checked for the current case. The failed flag is still clear, therefore the right path is taken from step 322 and case i is logged as "complete". In step 338, the case index is incremented and the feed counter reset to zero. Control then returns to step 304 where the batch processing continues.

Double Feed with Two Mammographic Images

The detection of a double feed error is now described. Assume simultaneous feeding of two mammographic images. In this situation, a case separator will be detected in step 308 when the feed counter is less than the number of films specified in the work list. Therefore, the right branch is taken out of step 312 and the bottom branch from step 316. The current case is logged as "canceled" in step 334. In step 338, the case index is incremented and the feed counter reset to zero. Control then returns to step 304 where the batch processing is allowed to continue.

Double Feed with Last Image and Case Separator

In this section, we describe the detection of a double feed error when the films involved are the last image film of a case and a case separator. In this situation, assume the case separator is not detected. This is reasonable assuming the default decision of the case separator detector is "image". When the films are double fed, it is unlikely that the unique pattern of the case separator will be found. Assume the case with index i* has four images, $n_i$*=4, and processes the first three films without error.

The double feed then occurs, pulling the fourth film and the case separator. In step 308, the film type is declared "image". In step 310, the feed counter is incremented from three to four. The feed counter is still less than the number of films in the case as specified in the work list, so the left branch is taken out of step 318. Assume the image based CAD is successful, so the left branch is followed from step 330. The next film is digitized in step 306 and determined to be an "image" in step 308. The feed counter is now incremented from four to five in step 310. In step 318 the feed counter is compared to the number of films in the case. Thus, the right branch is taken and case i* is logged as "canceled" in step 332. The case index is incremented to i+1 and the feed counter reset to zero in step 338. Control then returns to step 304 where the batch processing continues. Further assuming error free operation until the detection of the next case separator, step 312 will be entered with the feed counter one less than the number of films given in the work list. Therefore, the right branch of 312 and the bottom branch of 316 will be followed. Case i*+1 is logged as "canceled" in step 334. In step 338, the case index is incremented and the feed counter reset to zero. Control then returns to step 304 where the batch processing is allowed to continue.

Double Feed with Case Separator and First Image

The handling for a double feed error consisting of a case separator and the first image film of a case is now described. Assume the case with index i* has four images, $n_i$*=4, and was processed without error prior to the double feed. Therefore, the feed counter equals four. With the double feeding of the case separator and film, step 308 will declare the film type to be "image". The feed counter is incremented to five in step 310 and compared to the number of films in case i* at step 318. Since the feed counter is greater than the expected number of films, the right branch is taken and the current case is logged as "canceled" in step 332. The case index is incremented to i*+1 and the feed counter rest to zero in step 338. Control then returns to step 304 where the batch processing continues. Further assuming error free operation until the detection of the next case separator, step 312 will be entered with the feed counter one less than the number of films given in the work list for case index i*+1. Therefore, the right branch of 312 and the bottom branch of 316 will be followed. Case i*+1 is logged as "canceled", in step 334. In step 338, the case index is incremented and the feed counter reset to zero. Control then returns to step 304 where the batch processing is allowed to continue.

CAD Processing Failure

Finally, the error handling in the situation of a CAD processing failure is described. Assume the image based CAD in step 324 processes an image film resulting in a CAD failure. In step 330, the bottom path is taken, and the "failed" flag is set in step 336. Assume error free processing until the next case separator is detected in step 308, where the right branch is taken to step 312. The feed counter will equal the number of films in the case, so the left branch is followed to step 314, where case based processing is applied. In step 322, the "failed" flag is checked. Since the flag is set, the left branch is taken and the case is logged as "failed" in step 326. In step 338, the case index is incremented and the feed counter reset to zero. Control then returns to step 304 where the batch processing is allowed to continue.

We claim:

1. A method for batch processing a set of films including multiple film cases, the method including the steps of:

providing a number count of the number of films corresponding to each film case;

processing the set of films with a computer system;

determining a processed number of films processed by the system for each film case;

comparing the processed number to the number count for each film case;

identifying a difference between the processed number and the number count as a process error for the film case; and continuing to operate without operator intervention on subsequent film cases after a process error is identified in one film case while maintaining the processing sequence of a work list; wherein the step of identifying a process error includes testing two error conditions relating to processing the set of films, one error condition resulting from a double feed of a film and another film in the set of films, and the other error condition resulting from a double feed of a film and a case separator in the set of films.

2. The method of claim 1 including providing an output identifying a film case corresponding to a process error.

3. The method of claim 1 wherein the computer system comprises a CAD system.

4. The method of claim 3 including the step of detecting a CAD failure in processing at least one film of a film case and identifying the CAD failure as a process error for the film case.

5. The method of claim 4 wherein a case separator is provided between adjacent film cases for providing an indication of the end of one film case and the beginning of an adjacent film case.

6. The method of claim 5 wherein a difference between the processed number and the number count results from a double feed of a film and another film in the set of films.

7. The method of claim 5 wherein a difference between the processed number and the number count results from a double feed of a film and a case separator in the set of films.

8. The method of claim 1 wherein the system continues to operate on subsequent film cases after a process error is identified in one film case.

9. The method of claim 1 wherein the set of films comprise medical films and the film cases correspond to cases for different patients.

10. A method for batch processing a set of films including multiple film cases, the method including the steps of:

providing at least one error check on the status of processing the films in the set of films;

processing the film cases in the set of films with a computer system;

identifying a process error during processing based on the at least one error check;

inputting to the computer system information including the number of films in each film case, and the at least one error check comprises checking the number of films processed for a film case against the input information; and completing processing without operator intervention of all film cases in the set of films after a process error is identified in one film case while maintaining the processing sequence of a work list; wherein the step of identifying a process error includes testing two error conditions relating to processing the set of films, one error condition resulting from a double feed of a film and another film in the set of films, and the other error condition resulting from a double feed of a film and a case separator in the set of films.

11. The method of claim 10 including the step of providing an output identifying any film cases producing a process error during processing.

12. The method of claim 10 wherein the step of identifying a process error includes testing two error conditions relating to processing the set of films.

13. The method of claim 12 wherein testing of one of the error conditions includes the steps of:

providing a number count of the number of films corresponding to each film case;

determining a processed number of films processed by the system for each film case;

comparing the processed number to the number count for each film case; and identifying a difference between the processed number and the number count as a process error for the film case.

14. The method of claim 13 wherein the computer system comprises a CAD system and testing of one of the error conditions includes the step of detecting a CAD failure in processing at least one film of a film case.

15. The method of claim 10 wherein the computer system comprises a CAD system and the step of identifying a process error includes the step of detecting a CAD failure in processing at least one film of a film case.

16. The method of claim 10 wherein the set of films comprise medical films and the film cases correspond to cases for different patients, and including the step of inputting information from a patient work list to non-volatile memory.

17. The method of claim 16 including entering the information from a patient work list to the non-volatile memory both during processing of films and when the computer system is not processing films.

18. The method of claim 10 wherein the step of processing the film cases in the set of films with a computer system comprises feeding the films through the computer system and the process error corresponds to an error resulting from feeding multiple films together.

* * * * *